United States Patent [19]

Sakamaki et al.

[11] Patent Number: 4,548,558

[45] Date of Patent: Oct. 22, 1985

[54] ROTARY COMPRESSOR HOUSING

[75] Inventors: Hiroshi Sakamaki, Utsunomiya; Susumu Sugishita, Hanyu; Yukio Horikoshi, Kazo, all of Japan

[73] Assignee: Nippon Piston Ring Co., Ltd., Tokyo, Japan

[21] Appl. No.: 559,811

[22] Filed: Dec. 9, 1983

[30] Foreign Application Priority Data

Dec. 13, 1982 [JP] Japan ..... 57-217112

[51] Int. Cl.[4] ..... F04C 18/00; F04C 29/04; B32B 3/12

[52] U.S. Cl. ..... 418/83; 418/101; 418/173; 428/116; 428/118

[58] Field of Search ..... 418/83, 101, 173, 270; 428/116, 118

[56] References Cited

U.S. PATENT DOCUMENTS 1,945,220 1/1934 Eyston ..... 418/83
2,030,952 2/1936 Wishart ..... 418/101 X
2,620,124 12/1952 Brill et al. ..... 418/83
2,941,759 6/1960 Rice et al. ..... 428/118 X
3,210,933 10/1965 Crews et al. ..... 428/116 X
3,832,267 8/1974 Liu ..... 428/118 X

FOREIGN PATENT DOCUMENTS 708720 5/1965 Canada ..... 428/118

*Primary Examiner*—John J. Vrablik
*Assistant Examiner*—Theodore Olds
*Attorney, Agent, or Firm*—Birch, Stewart, Kolasch & Birch

[57] ABSTRACT

A rotary compressor housing is outwardly formed with reinforcing grids in the form of square, diaper or honeycomb. The reinforcing grids allow the intermediate wall portions between the bolted wall portions to thermally expand as much as the bolted wall portions, resulting in that the inner periphery of the center housing always keep its circularity when the inner temperature rises due to an unavoidable compression of air.

8 Claims, 6 Drawing Figures

ROTARY COMPRESSOR HOUSING

BACKGROUND OF THE INVENTION

1. Field of the Invention

The invention relates to a rotary compressor housing for use in a movable-vane compressor that is utilizable as a supercharger for an internal combustion engine.

2. Description of the Prior Art

It is unavoidable that the compressor housing is heated and caused to thermally expand by adiabatic compression of air while the compressor runs. In general, the center housing is axially secured to the opposite side housings or the like by four or more bolts which are circularly equidistantly disposed to pass through the center and the side housings and fasten them as one body. The bolts prevent the bolted portions of the center housing from radially thermally expanding but permit the radial thermal expansion of the four intermediate portions between the adjacent bolted portions, so that the inner periphery of the center housing thermally expands in the form of a somewhat square. Therefore, there is the possiblity of a trouble that the inner periphery of the center housing is thermally deformed to reduce the performance of compressor.

In Japanese Published Unexamined Patent Application No. 58-65988 published on Apr. 19, 1983, we have shown a rotary compressor provided with a rotary sleeve interposed between a center housing and a rotor and floatingly supported by compressible fluid. The compressor is particularly suitable for a supercharger with use for an automobile engine required to operate over a wide range of speeds. The rotary sleeve rotates together with the vanes to prevent frictional heat and wear at the apex of each vane. However, if the inner periphery of the center housing is thermally deformed the bearing capacity of the air-bearing room defined between the inner periphery of the center housing and the outer periphery of the rotary sleeve may lower to the extent that the rotary sleeve scuffs the inner periphery of the center housing.

SUMMARY OF THE INVENTION

The primary object of the invention is to provide a rotary compressor housing of which the inner periphery always keeps its roundness irrespective of a temperatur-rise in the compressor due to an unavoidable adiabatic compression.

To accomplish the object as described, the compressor housing of the invention comprises a center housing having the outer periphery thereof integrally formed with reinforcing grids. The grid may be either of square, diaper, and honeycomb. The reinforcing grids decentralize thermal stress in the intermediate portions between the adjacent bolted portions and prevent the inner periphery of the center housing from becoming out of roundness. The reinforcing grids radiate heat efficiently from the center housing to the open air. In particular, the honeycomb or diapered grids is more effective to cool the center housing because of producing discontinuous air-flowing about the outer periphery of the center housing.

The advantages offered by the invention are mainly that the compressor performance is not lowered by a temperature-rise due to an unavoidable adiabatic air-compression. And further there hardly occurs a scuffing or seizing trouble in the compressor of the type having a rotary sleeve mounted in a center housing for rotation with a plurality of vanes.

The other objects and advantages of the invention will become apparent from the following detailed description of the invention in conjunction with the attached drawings.

DETAILED DESCRIPTION OF THE PREFERRED EMBODIMENTS

Figure 1:
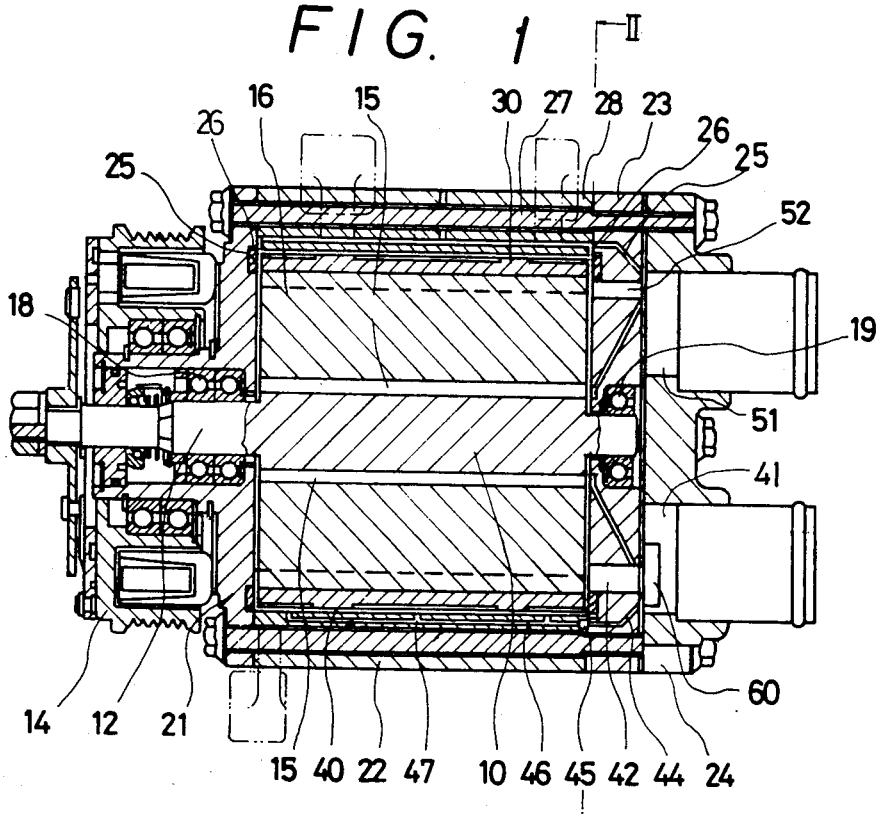
FIG. 1 is an axial section of the compressor of the invention.

The compressor housing of the invention is described in detail below with reference to the drawings. Referring initially to FIG. 1, the compressor has a rotor 10 integrally provided with a rotary shaft 12, which is rotatably supported by bearings 18, 19 in the respective front and rear side housings 21, 23 and fixed at the front end to a pulley 14 which is rotated by a non-illustrated engine. A plurality of vanes 16 are radially slidably fitted in the respective vane grooves 15 in the rotor 10 and have their apex in contact with the inner periphery of a rotary sleeve 30. The rotary sleeve 30 is mounted within the center housing 22 to define an air-bearing room 40 of 0.02–0.15 mm width therebetween. Gasket is interposed between the rear side housing 23 and the rear cover 24 in which discharge and suction chambers 41, 51 are provided. The discharge chamber 41 is internally connected through a discharge valve 60 to a discharge port 42 and the suction chamber 51 is internally connected to a suction port 52. The rear side housing 23 is formed with a high-pressure hole 44 extending from the discharge valve 60 to high-pressure groove 45 in the joining surface between the center housing 22 and the rear side housing 23. Center housing 22 is formed with a high-pressure passage 46, which extends axially from the high-pressure groove 45. The high-pressure passage 46 is provided with a plurality of throttles 47 opened to an air-bearing room 40 defined by the inner periphery of the center housing and the outer periphery of the rotary sleeve 30. Thus, the discharge chamber 41 is internally connected to the air-bearing room 40. Bolts 27 pass through the thickened portions 28 of the center housing 22, the front and rear side housings 21, 23, and the rear cover 24 to fasten them axially as one body. The front and rear side housings 21, 23 are formed in the inner surfaces with annular grooves 26 in which the oilless bearing members 25, made of carbon, alumina, silicon nitride or the like, are embedded for smooth contact with the respective side surfaces of the rotary sleeve 30.

Figure 2:
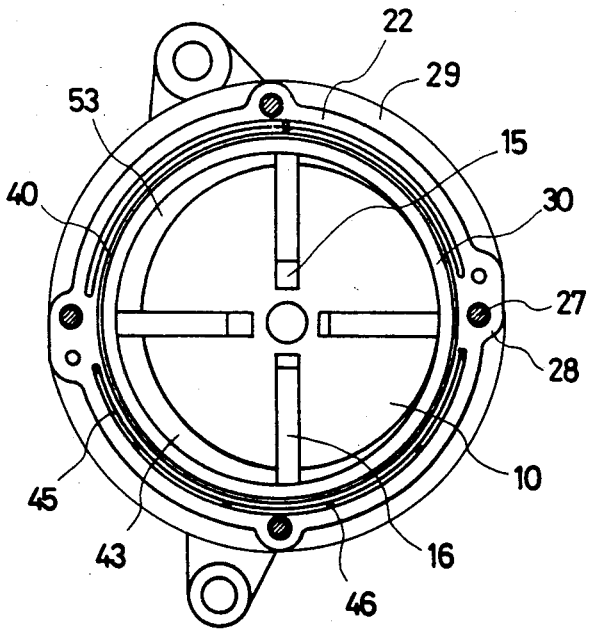
FIG. 2 is a section taken along line II—II of FIG. 1.

As seen in FIG. 2, the high-pressure passages 46 are disposed on the high-pressure groove 45 which forms a circular arc of subtended angle of about 170 degrees in the compression side of the compressor. Four vanes 16 fitted in the vane grooves 15 confine suction working space 53 in the suction side and compression working space 43 in the compression side together with the outer periphery of the rotor 10 and the inner periphery of the rotary sleeve 30. Four bolts 27 are circularly equidistantly disposed in the thickened portions 28 of the center housing 22. The thickened portions 28 are peripherally connected to each other by reinforcing grids 29.

The air-bearing room 40 between the rotary sleeve 30 and the center housing 22 should keep its circularity to floatingly support the rotary sleeve 30.

Figure 3:
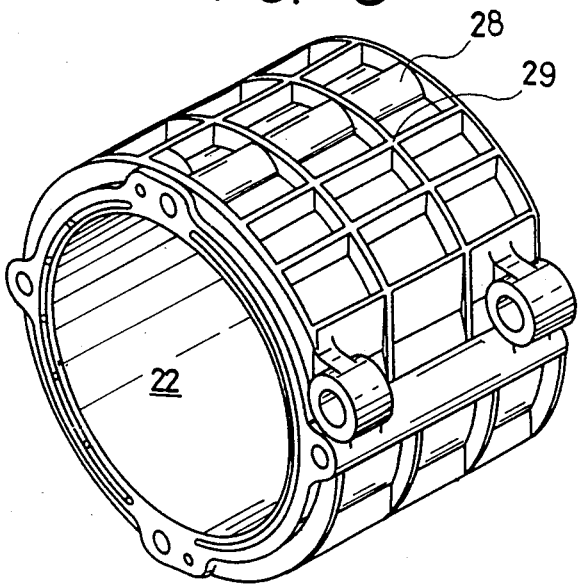
FIGS. 3 and 4 are pictorial and sectional views of the center housing of FIGS. 1 and 2.
Figure 4:
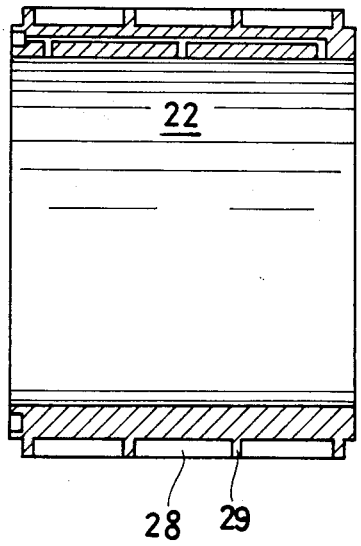
Figure 5:
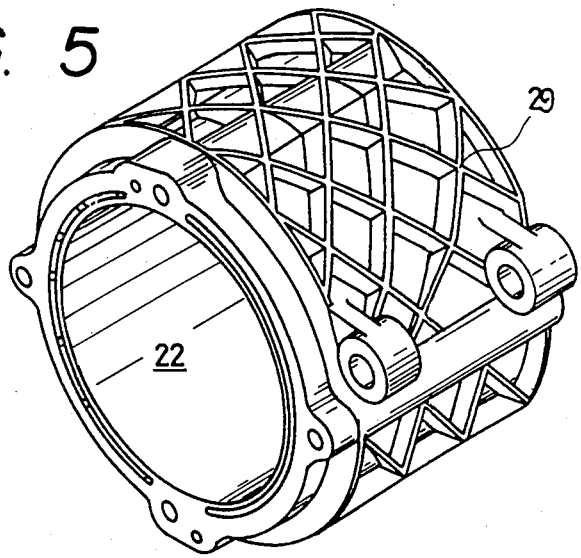
FIGS. 5 and 6 are pictorial views of other embodiments, similar to FIG. 3.
Figure 6:
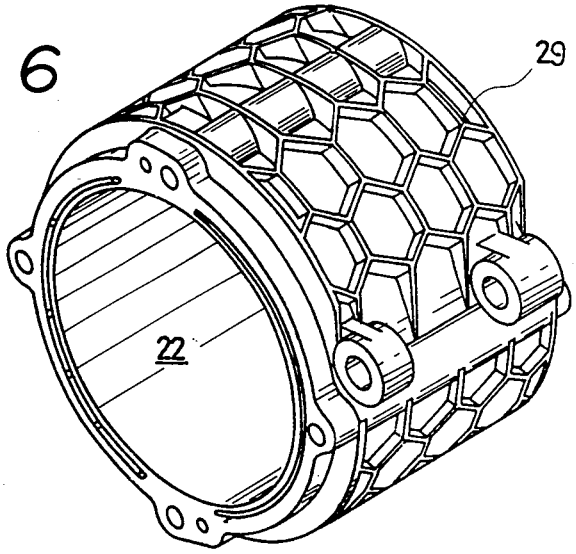

As seen in FIGS. 3 and 4, the center housing 22 has its outer periphery integrally formed with square reinforcing grids 29 which extend in the both axial and peripheral directions. The reinforcing grids are the same in radial thickness as the thick wall 28 through which the bolt passes. The reinforcing grids 29 are not limited to be square but shaped in either form of diaper and honeycome as seen in FIGS. 5 and 6. The reinforcing grids 29 axially terminate in the opposite flanges of the center housing 22 to which the front and rear side housings are secured.

In operation, the rotation of engine is transmitted to the rotor 10 by the pulley 14. As the rotor 10 rotates, air is adiabatically compressed in the compression working space 43 thus raising its temperature. This heat is transferred to the center housing 22 through the rotary sleeve 30. Frictional heat, generated in the bearings, sealings, and other parts, is also transferred to the center housing 22. Consequently, the center housing 22 has it's temperature rise to about 85 C. and thermally expands. The reinforcing grids 29 permit the intermediate portions between the bolted portions 28 to expand thermally as much as the vicinity of the bolted portions 28 in the both axial and radial directions, resulting in that the inner periphery of the center housing 22 expands without deforming its circularity. Otherwise, the intermediate portion would expand more than the vicinity of the bolted portions 28 to shape the inner periphery of the center housing 22 in the form of a somewhat square. The air-bearing room 40 between the inner periphery of the center housing 22 and the outer periphery of the rotary sleeve 30 always keeps its circularity and the same bearing capacity to floatingly support the rotary sleeve 30 irrespective of the temperature rise in the compressor, so that the rotary sleeve 30 can rotate without scuffing nor seizing the inner periphery of the center housing 22. The diapered or honeycomb reinforcing grids 29 not only radiate heat from the center housing 22 but also produce discontinuous air-flowing to cool the center housing 22 with the result that the temperature in the center housing 22 does not exceed a tolerable limit.

It will be understood that the rotary compressor housing of the invention is not only available for the rotary compressor of the type having a rotary sleeve as described above, but also the conventional one in which the vanes frictionally slide along the inner periphery of the center housing.

What is claimed is:

1. A rotary compressor housing for use in a sliding-vane type compressor comprising a center housing having the outer periphery thereof integrally formed with reinforcing grids containing circumferentially and axially extending ribs, and front and rear side housings fastened to said center housing with the intervention of a plurality of bolts, said center housing being formed with a plurality of thickened portions which extend the entire axial length thereof and through which said bolts pass, said thickened portions being peripherally connected with each other by said reinforcing grids, whereby the inner periphery of the center housing can expand thermally without losing its circular shape.

2. A rotary compressor housing as claimed in claim 1, wherein said reinforcing grids are square.

3. A rotary compressor housing as claimed in claim 1, wherein said reinforcing grids are diapered.

4. A rotary compressor housing as claimed in claim 1, wherein said reinforcing grids are honeycomb.

5. A rotary compressor housing for use in a compressor in which a plurality of vanes rotate with a rotary sleeve, said rotary compressor housing comprising a center housing having the outer periphery thereof integrally formed with reinforcing grids containing circumferentially and axially extending ribs, and front and rear side housings fastened to said center housing with the intervention of a plurality of bolts, said center housing being formed with a plurality of thickened portions which extend the entire axial length thereof and through which said bolts pass, said thickened portions being peripherally connected with each other by said reinforcing grids, whereby the inner periphery of the center housing can expand thermally without losing its circular shape.

6. A rotary compressor housing as claimed in claim 5, wherein said reinforcing grids are square.

7. A rotary compressor housing as claimed in claim 5, wherein said reinforcing grids are diapered.

8. A rotary compressor housing as claimed in claim 5, wherein said reinforcing grids are honeycomb.

* * * * *